US007896465B2

(12) United States Patent
Brown et al.

(10) Patent No.: US 7,896,465 B2
(45) **Date of Patent: *Mar. 1, 2011**

(54) INKJET PRINTHEAD WITH A PRINTER CONTROLLER FOR CONTROLLING NOZZLE FIRING SEQUENCE

(75) Inventors: Brian Robert Brown, Balmain (AU); Simon Robert Walmsley, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 340 days.

This patent is subject to a terminal disclaimer.

(21) Appl. No.: 12/240,840

(22) Filed: Sep. 29, 2008

(65) Prior Publication Data

US 2009/0021547 A1 Jan. 22, 2009

Related U.S. Application Data

(63) Continuation of application No. 11/293,798, filed on Dec. 5, 2005, now Pat. No. 7,455,376.

(51) Int. Cl.
*B41J 2/155* (2006.01)

(52) U.S. Cl. ..... 347/42; 347/5; 347/13

(58) Field of Classification Search ..... 347/5, 347/9, 12, 13, 42, 43

See application file for complete search history.

(56) References Cited

U.S. PATENT DOCUMENTS 6,039,425 A 3/2000 Sekiya et al.
6,183,056 B1 2/2001 Corrigan et al.
6,409,331 B1 6/2002 Gelbart
6,478,396 B1 11/2002 Schloeman et al.
6,498,615 B1 12/2002 Chwalek et al.
6,585,339 B2 7/2003 Schloeman et al.
6,644,766 B1 11/2003 Ellson
6,755,495 B2 6/2004 Beck et al.
6,767,073 B2 * 7/2004 Tschida ..... 347/13
7,029,084 B2 4/2006 Schloeman et al.
7,266,661 B2 9/2007 Walmsley
2002/0051024 A1 5/2002 Naoi
2002/0126168 A1 9/2002 Anderson
2003/0107611 A1 6/2003 Kim
2003/0132988 A1 7/2003 Beck et al.
2005/0078133 A1 4/2005 Molinet et al.
2005/0122355 A1 6/2005 Kanda et al.

(Continued)

FOREIGN PATENT DOCUMENTS

EP 0900656 A2 3/1999

(Continued)

*Primary Examiner*—Lam S Nguyen

(57) ABSTRACT

An inkjet printhead includes a number of printhead modules arranged end-to-end to span a width of a page, the printhead modules defining color channels also to span the width of the page. A plurality of inkjet nozzles is arranged on the modules such that rows of the nozzles span the width of the page, with at least one row of nozzles in fluid communication with respective channels, the nozzles capable of being fired to eject ink from their associated channels, the nozzles of each row on an associated module defining a segment of nozzles. A printer controller controls a firing sequence of the nozzles and is configured so that nozzles from segments associated with different color channels are fired sequentially during a predetermined time allocated for firing a line of nozzles.

4 Claims, 3 Drawing Sheets

U.S. PATENT DOCUMENTS

2006/0092221 A1* 5/2006 Jeong ..... 347/42

FOREIGN PATENT DOCUMENTS

EP 0953451 A2 11/1999
EP 1241006 A2 9/2002
EP 0913255 B1 5/2003
EP 1221372 B1 6/2005
JP 2005041136 A 2/2005

* cited by examiner

INKJET PRINTHEAD WITH A PRINTER CONTROLLER FOR CONTROLLING NOZZLE FIRING SEQUENCE

This application is a continuation application of U.S. patent application Ser. No. 11/293,798 filed on Dec. 5, 2005, now U.S. Pat. No. 7,455,376, which is herein incorporated by reference.

FIELD OF THE INVENTION

This invention relates to a method of printing from an inkjet printhead, whilst modulating a peak power requirement for the printhead. It has been developed primarily to reduce the demands on a pagewidth printhead power supply, although other advantages of the methods of printing described herein will be apparent to the person skilled in the art.

CO-PENDING APPLICATIONS

The following applications have been filed by the Applicant simultaneously with the present application:

| | | | | | |
|---|---|---|---|---|---|
| 11/293,800 | 11/293,802 | 11/293,801 | 11/293,808 | 11/293,809 | 11/293,832 |
| 11/293,838 | 11/293,825 | 11/293,841 | 11/293,799 | 11/293,796 | 11/293,797 |
| 11/293,804 | 11/293,840 | 11/293,803 | 11/293,833 | 11/293,834 | 11/293,835 |
| 11/293,836 | 11/293,837 | 11/293,792 | 11/293,794 | 11/293,839 | 11/293,826 |
| 11/293,829 | 11/293,830 | 11/293,827 | 11/293,828 | 7,270,494 | 11/293,823 |
| 11/293,824 | 11/293,831 | 11/293,815 | 11/293,819 | 11/293,818 | 11/293,817 |
| 11/293,816 | 11/293,820 | 11/293,813 | 11/293,822 | 11/293,812 | 7,357,496 |
| 11/293,814 | 11/293,793 | 11/293,842 | 11/293,811 | 11/293,807 | 11/293,806 |
| 11/293,805 | 11/293,810 | | | | |

The disclosures of these co-pending applications are incorporated herein by reference. The above applications have been identified by their filing docket number, which will be substituted with the corresponding application number, once assigned.

CROSS REFERENCES TO RELATED APPLICATIONS

Various methods, systems and apparatus relating to the present invention are disclosed in the following US Patents/Patent Applications filed by the applicant or assignee of the present invention:

| | | | | | |
|---|---|---|---|---|---|
| 6,750,901 | 6,476,863 | 6,788,336 | 7,249,108 | 6,566,858 | 6,331,946 |
| 6,246,970 | 6,442,525 | 7,346,586 | 09/505,951 | 6,374,354 | 7,246,098 |
| 6,816,968 | 6,757,832 | 6,334,190 | 6,745,331 | 7,249,109 | 7,197,642 |
| 7,093,139 | 10/636,263 | 10/636,283 | 10/866,608 | 7,210,038 | 7,401,223 |
| 10/940,653 | 10/942,858 | 7,364,256 | 7,258,417 | 7,293,853 | 7,328,968 |
| 7,270,395 | 11/003,404 | 11/003,419 | 7,334,864 | 7,255,419 | 7,284,819 |
| 7,229,148 | 7,258,416 | 7,273,263 | 7,270,393 | 6,984,017 | 7,347,526 |
| 7,357,477 | 11/003,463 | 7,364,255 | 7,357,476 | 11/003,614 | 7,284,820 |
| 7,341,328 | 7,246,875 | 7,322,669 | 11/246,676 | 11/246,677 | 11/246,678 |
| 11/246,679 | 11/246,680 | 11/246,681 | 11/246,714 | 7,425,051 | 7,399,057 |
| 11/246,671 | 11/246,704 | 11/246,710 | 11/246,688 | 7,399,054 | 7,425,049 |
| 7,367,648 | 7,370,936 | 7,401,886 | 11/246,708 | 7,401,887 | 7,384,119 |
| 7,401,888 | 7,387,358 | 7,413,281 | 10/922,842 | 10/922,848 | 6,623,101 |
| 6,406,129 | 6,505,916 | 6,457,809 | 6,550,895 | 6,457,812 | 7,152,962 |
| 6,428,133 | 7,204,941 | 7,282,164 | 10/815,628 | 7,278,727 | 7,417,141 |
| 10/913,374 | 7,367,665 | 7,138,391 | 7,153,956 | 7,423,145 | 10/913,379 |
| 10/913,376 | 7,122,076 | 7,148,345 | 11/172,816 | 11/172,815 | 11/172,814 |
| 7,416,280 | 7,252,366 | 10/683,064 | 7,360,865 | 11/293,798 | 11/124,202 |
| 7,392,950 | 7,236,271 | 11/124,201 | 11/124,167 | 11/228,481 | 11/228,477 |
| 7,357,311 | 7,380,709 | 11/228,521 | 7,403,796 | 6,746,105 | 11/246,687 |

-continued

| | | | | | |
|---|---|---|---|---|---|
| 11/246,718 | 7,322,681 | 11/246,686 | 11/246,703 | 11/246,691 | 11/246,711 |
| 11/246,690 | 11/246,712 | 11/246,717 | 7,401,890 | 7,401,910 | 11/246,701 |
| 11/246,702 | 11/246,668 | 11/246,697 | 11/246,698 | 11/246,699 | 11/246,675 |
| 11/246,674 | 11/246,667 | 7,156,508 | 7,159,972 | 7,083,271 | 7,165,834 |
| 7,080,894 | 7,201,469 | 7,090,336 | 7,156,489 | 7,413,283 | 10/760,246 |
| 7,083,257 | 7,258,422 | 7,255,423 | 7,219,980 | 10/760,253 | 7,416,274 |
| 7,367,649 | 7,118,192 | 10/760,194 | 7,322,672 | 7,077,505 | 7,198,354 |
| 7,077,504 | 10/760,189 | 7,198,355 | 7,401,894 | 7,322,676 | 7,152,959 |
| 7,213,906 | 7,178,901 | 7,222,938 | 7,108,353 | 7,104,629 | 7,303,930 |
| 11/246,672 | 7,401,405 | 11/246,683 | 11/246,682 | 7,246,886 | 7,128,400 |
| 7,108,355 | 6,991,322 | 7,287,836 | 7,118,197 | 10/728,784 | 7,364,269 |
| 7,077,493 | 6,962,402 | 10/728,803 | 7,147,308 | 10/728,779 | 7,118,198 |
| 7,168,790 | 7,172,270 | 7,229,155 | 6,830,318 | 7,195,342 | 7,175,261 |
| 10/773,183 | 7,108,356 | 7,118,202 | 10/773,186 | 7,134,744 | 10/773,185 |
| 7,134,743 | 7,182,439 | 7,210,768 | 10/773,187 | 7,134,745 | 7,156,484 |
| 7,118,201 | 7,111,926 | 10/773,184 | 7,018,021 | 7,401,901 | 11/060,805 |
| 11/188,017 | 11/097,308 | 11/097,309 | 7,246,876 | 11/097,299 | 7,419,249 |
| 7,377,623 | 7,328,978 | 7,334,876 | 7,147,306 | 09/575,197 | 7,079,712 |
| 6,825,945 | 7,330,974 | 6,813,039 | 6,987,506 | 7,038,797 | 6,980,318 |
| 6,816,274 | 7,102,772 | 7,350,236 | 6,681,045 | 6,728,000 | 7,173,722 |
| 7,088,459 | 09/575,181 | 7,068,382 | 7,062,651 | 6,789,194 | 6,789,191 |
| 6,644,642 | 6,502,614 | 6,622,999 | 6,669,385 | 6,549,935 | 6,987,573 |
| 6,727,996 | 6,591,884 | 6,439,706 | 6,760,119 | 7,295,332 | 6,290,349 |
| 6,428,155 | 6,785,016 | 6,870,966 | 6,822,639 | 6,737,591 | 7,055,739 |
| 7,233,320 | 6,830,196 | 6,832,717 | 6,957,768 | 09/575,172 | 7,170,499 |
| 7,106,888 | 7,123,239 | 10/727,181 | 10/727,162 | 7,377,608 | 7,399,043 |
| 7,121,639 | 7,165,824 | 7,152,942 | 10/727,157 | 7,181,572 | 7,096,137 |
| 7,302,592 | 7,278,034 | 7,188,282 | 10/727,159 | 10/727,180 | 10/727,179 |
| 10/727,192 | 10/727,274 | 10/727,164 | 10/727,161 | 10/727,198 | 10/727,158 |
| 10/754,536 | 10/754,938 | 10/727,160 | 10/934,720 | 7,171,323 | 7,369,270 |
| 6,795,215 | 7,070,098 | 7,154,638 | 6,805,419 | 6,859,289 | 6,977,751 |
| 6,398,332 | 6,394,573 | 6,622,923 | 6,747,760 | 6,921,144 | 10/884,881 |
| 7,092,112 | 7,192,106 | 11/039,866 | 7,173,739 | 6,986,560 | 7,008,033 |
| 11/148,237 | 7,222,780 | 7,270,391 | 7,195,328 | 7,182,422 | 7,374,266 |
| 10/854,522 | 10/854,488 | 7,281,330 | 10/854,503 | 7,328,956 | 10/854,509 |
| 7,188,928 | 7,093,989 | 7,377,609 | 10/854,495 | 10/854,498 | 10/854,511 |
| 7,390,071 | 10/854,525 | 10/854,526 | 10/854,516 | 7,252,353 | 10/854,515 |
| 7,267,417 | 10/854,505 | 10/854,493 | 7,275,805 | 7,314,261 | 10/854,490 |
| 7,281,777 | 7,290,852 | 10/854,528 | 10/854,523 | 10/854,527 | 10/854,524 |
| 10/854,520 | 10/854,514 | 10/854,519 | 10/854,513 | 10/854,499 | 10/854,501 |
| 7,266,661 | 7,243,193 | 10/854,518 | 10/854,517 | 10/934,628 | 7,163,345 |
| 10/760,254 | 7,425,050 | 7,364,263 | 7,201,468 | 7,360,868 | 10/760,249 |
| 7,234,802 | 7,303,255 | 7,287,846 | 7,156,511 | 10/760,264 | 7,258,432 |
| 7,097,291 | 10/760,222 | 10/760,248 | 7,083,273 | 7,367,647 | 7,374,355 |
| 10/760,204 | 10/760,205 | 10/760,206 | 10/760,267 | 10/760,270 | 7,198,352 |
| 7,364,264 | 7,303,251 | 7,201,470 | 7,121,655 | 7,293,861 | 7,232,208 |
| 7,328,985 | 7,344,232 | 7,083,272 | 11/014,764 | 11/014,763 | 7,331,663 |
| 7,360,861 | 7,328,973 | 11/014,760 | 7,407,262 | 7,303,252 | 7,249,822 |
| 11/014,762 | 7,311,382 | 7,360,860 | 7,364,257 | 7,390,075 | 7,350,896 |
| 11/014,758 | 7,384,135 | 7,331,660 | 7,416,287 | 11/014,737 | 7,322,684 |
| 7,322,685 | 7,311,381 | 7,270,405 | 7,303,268 | 11/014,735 | 7,399,072 |
| 7,393,076 | 11/014,750 | 11/014,749 | 7,249,833 | 11/014,769 | 11/014,729 |
| 7,331,661 | 11/014,733 | 7,300,140 | 7,357,492 | 7,357,493 | 11/014,766 |
| 7,380,902 | 7,284,816 | 7,284,845 | 7,255,430 | 7,390,080 | 7,328,984 |
| 7,350,913 | 7,322,671 | 7,380,910 | 11/014,717 | 11/014,716 | 11/014,732 |
| 7,347,534 | 11/097,268 | 11/097,185 | 7,367,650 | | |

An application has been listed by its docket number. This will be replaced when the application number is known. The disclosures of these applications and patents are incorporated herein by reference.

BACKGROUND TO THE INVENTION

Inkjet printers are now commonplace in homes and offices. For example, inkjet photographic printers, which print color images generated on digital cameras, are, to an increasing extent, replacing traditional development of photographic negatives. With the increasing use of inkjet printers, the demands of such printers in terms of print quality and speed, continue to increase.

All commercially available inkjet printers use a scanning printhead, which traverses across a stationary print medium. After each sweep of the printhead, the print medium incrementally advances ready for the next line(s) of printing. Such printers are inherently slow and are becoming unable to meet the needs of current demands of inkjet printers.

The present Applicant has previously described many different types of pagewidth printheads, which are fabricated using MEMS technology. In pagewidth printing, the print medium is continuously fed past a stationary printhead, thereby allowing high-speed printing at, for example, one page per 1-2 seconds. Moreover, MEMS fabrication of the printhead allows a much higher nozzle density than traditional scanning printheads, and print resolutions of 1600 dpi are possible.

Some of the Applicant's MEMS pagewidth printheads are described in the patents and patent applications listed in the cross-references section above, the contents of which are herein incorporated by reference.

To a large extent, pagewidth printing has been made possible by reducing the total energy required to fire each ink droplet and/or efficiently removing heat from the printhead via ejected ink. In these ways, self-cooling of the printhead can be achieved, which enables a pagewidth printhead having a high nozzle density to operate without overheating.

However, whilst a total amount of energy to print, say, a full-color photographic page will be approximately constant for any given pagewidth printhead, the power requirement of the printhead may, of course, vary. An average power requirement for printing a page is determined by the total energy required and the total time taken to print the page, assuming an equal distribution of printing over the time period. In addition, the power requirement of the printhead during printing of the page may fluctuate. Due to a particular configuration of the printhead or printer controller, some lines of print may consume more power than other lines of print. Hence, a peak power requirement for each line of printing may be different.

In a typical pagewidth printhead, nozzles ejecting the same color of ink are arranged longitudinally in color channels along the length of the printhead. Each color channel may comprise one or more rows of nozzles, all ejecting the same colored ink. In a simple example, there may be one cyan row of nozzles, one magenta row of nozzles and one yellow row of nozzles. Usually, each row of nozzles will be fired sequentially during printing e.g. cyan then magenta then yellow.

Furthermore, a typical pagewidth printhead may be comprised of a plurality of printhead modules, which abut each other and cooperate to form a printhead extending across a width of the page to be printed. Each printhead module is typically a printhead integrated circuit comprising nozzles and drive circuitry for firing the nozzles. The rows of nozzles extend over the plurality of printhead modules, with each printhead module including a respective segment of each nozzle row.

In previous patent applications, listed below, we described various types of printheads, printer controllers and methods of printing. The contents of these patent applications are herein incorporated by reference:

| | | | | | |
|---|---|---|---|---|---|
| 7,374,266 | 10/854,522 | 10/854,488 | 7,281,330 | 10/854,503 | 7,328,956 |
| 10/854,509 | 7,188,928 | 7,093,989 | 7,377,609 | 10/854,495 | 10/854,498 |
| 10/854,511 | 7,390,071 | 10/854,525 | 10/854,526 | 10/854,516 | 10/854,508 |
| 7,252,353 | 10/854,515 | 7,267,417 | 10/854,505 | 10/854,493 | 7,275,805 |
| 7,314,261 | 10/854,490 | 7,281,777 | 7,290,852 | 10/854,528 | 10/854,523 |
| 10/854,527 | 10/854,524 | 10/854,520 | 10/854,514 | 10/854,519 | 10/854,513 |
| 10/854,499 | 10/854,501 | 7,266,661 | 7,243,193 | 10/854,518 | 10/854,517 |
| 10/934,628 | 7,163,345 | | | | |

In our previous patent applications U.S. Ser. No. 10/854,498, filed May 27, 2004, U.S. Ser. No. 10/854,516, filed May 27, 2004 and U.S. Ser. No. 10/854,508, filed May 27, 2004, we described a method of printing a line of dots where not all nozzles in one row or one segment are fired simultaneously. Rather, the nozzles are fired sequentially in firing groups in order to minimize the peak power requirement during printing of one line. As a consequence, each line of printing is typically not a perfectly straight line (unless the physical arrangements of the nozzles directly compensates for the firing order in which case it can be a straight line), although this imperfection is undetectable to the human eye. Each segment on a printhead module may comprise, for example, 10 firing groups of nozzles, in order to minimize, as far as possible within the print speed requirements, the peak power requirement for firing that segment of the nozzle row.

In our previous patent applications U.S. Ser. No. 10/854,512, filed May 27, 2004 and U.S. Ser. No. 10/854,491, filed May 27, 2004, we described a means for joining abutting printhead modules such that the effective distance between adjacent nozzles ('nozzle pitch') in the row remains constant. At one end of each printhead module, there is a displaced nozzle row portion, which is not aligned with its corresponding nozzle row. The firing of these displaced nozzles is timed so that they effectively print onto the same line as the row to which they correspond. As such, all references to "rows", "rows of nozzles" or "nozzle rows" herein include nozzle rows comprising one or more displaced row portions, as described in U.S. Ser. No. 10/854,512, filed May 27, 2004 and U.S. Ser. No. 10/854,491, filed May 27, 2004.

In our previous patent applications U.S. Ser. No. 10/854,507, filed May 27, 2004 and U.S. Ser. No. 10/854,523, filed May 27, 2004, we described a means by which the visual effect of defective nozzles is reduced. The printhead described comprises one or more 'redundant' color channels, so that for a first row of nozzles ejecting a given color, there is a corresponding second ('redundant') row of nozzles from a different color channel which eject the same color. As described in U.S. Ser. No. 10/854,507, filed May 27, 2004 and U.S. Ser. No. 10/854,523, filed May 27, 2004, one line may be printed by the first nozzle row and the next line is printed by the second nozzle row so that the first and second nozzle rows print alternate lines on the page. Thus, if there are unknown defective nozzles in a given row, the visual effect on the page is halved, because only every other line is printed using that row of nozzles.

Alternatively, if there are known dead nozzles in a given row, the corresponding row of nozzles may be used to print dots in those positions where there is a known dead nozzle. In other words, only a small number of nozzles in the 'redundant' row may be used to print.

As already mentioned, the redundancy scheme described in U.S. Ser. No. 10/854,507, filed May 27, 2004 and U.S. Ser. No. 10/854,523, filed May 27, 2004 has the advantage of reducing the visual impact of dead nozzles, either known or unknown. Moreover, careful choice of redundant colors may be used to further reduce the visual impact of dead nozzles. For example, since yellow makes the lowest contribution (11%) to luminance, the human eye is least sensitive to missing yellow dots and, therefore, yellow would be a poor choice for a redundant color. On the other hand, black, makes a much higher contribution to luminance and would be a good choice for a redundant color.

However, while the redundancy scheme described in U.S. Ser. No. 10/854,507, filed May 27, 2004 and U.S. Ser. No. 10/854,523, filed May 27, 2004 can compensate for dead nozzles and reduce (e.g. halve) the number of dots fired by some nozzles, it places increased demands on the power supply which is used to power the printhead. The reason is because in the time it takes for the print medium to advance by one line (one 'line-time'), each nozzle row must be allotted a portion of the line-time in which to fire, in order to achieve dot-on-dot printing and provide the desired image. Each nozzle row is allotted a portion of the line-time, since not all nozzle rows can fire simultaneously. (If all nozzle rows were to fire simultaneously, there would be an unacceptable current overload of the printhead).

In a simple CMY pagewidth printhead, having three rows of nozzles and no redundant color channels, each nozzle row must fire in one-third of the line-time. If the average power requirement of the printhead is x, then the peak power requirement over the duration of the line-time is as shown in Table 1:

TABLE 1

| Line-time | Color Channel | Peak Power Requirement |
|---|---|---|
| 0 | C | x |
| 0.33 | M | x |
| 0.67 | Y | x |
| 0 (new line) | C | x . . . etc. |

In this simple CMY printhead with no redundant nozzles, power is distributed evenly over the duration of the line-time so that the peak power requirement is constant and equal to the average power requirement of the printhead. From the standpoint of the power supply, this situation is optimal, but, on the other hand, there is no means for minimizing the visual effects of dead nozzles.

In a CMY printhead having redundant cyan and magenta color channels (i.e. C1, C2, M1, M2 and Y color channels) and a pair of nozzle rows in each color channel (for even and odd dots), each nozzle row is allotted one-tenth of the line-time, since there are now ten nozzle rows. Now if the average power requirement of the printhead is x, with the redundancy scheme and firing sequence described in U.S. Ser. No. 10/854,507, filed May 27, 2004 and U.S. Ser. No. 10/854,523, filed May 27, 2004, the peak power requirement over the duration of two line-times is as shown in Table 2:

TABLE 2

| Line-time | Color Channel | Peak Power Requirement |
|---|---|---|
| 0 | C1 (even) | 1.67x |
| 0.1 | C2 (even) | 0 |
| 0.2 | M1 (even) | 1.67x |
| 0.3 | M2 (even) | 0 |
| 0.4 | Y (even) | 1.67x |
| 0.5 | C1 (odd) | 1.67x |
| 0.6 | C2 (odd) | 0 |
| 0.7 | M1 (odd) | 1.67x |
| 0.8 | M2 (odd) | 0 |
| 0.9 | Y (odd) | 1.67x |
| 0 (new line) | C1 (even) | 0 |
| 0.1 | C2 (even) | 1.67x |
| 0.2 | M1 (even) | 0 |
| 0.3 | M2 (even) | 1.67x |
| 0.4 | Y (even) | 1.67x |
| 0.5 | C1 (odd) | 0 |
| 0.6 | C2 (odd) | 1.67x |
| 0.7 | M1 (odd) | 0 |

TABLE 2-continued

| Line-time | Color Channel | Peak Power Requirement |
|---|---|---|
| 0.8 | M2 (odd) | 1.67x |
| 0.9 | Y (odd) | 1.67x |
| 0 (new line) | C1 (even) | 1.67x . . . etc |

It is evident from the above table that the peak power requirement of the printhead fluctuates severely between 1.67x and 0 within the period of a line-time, even though the average power consumed over the whole line-time is still x. In practical terms, it is difficult to manufacture a power supply which is able to deliver severely fluctuating amounts of power within each line-time. Hence, the redundancy described in U.S. Ser. No. 10/854,507, filed May 27, 2004 and U.S. Ser. No. 10/854,523, filed May 27, 2004 is difficult to implement in practice, even though it offers considerable advantages in terms of reducing the visual effects of known dead nozzles.

Of course, a printhead could be configured not to fire redundant color channels in a given line-time, resulting in an average of x peak power for each nozzle row. Such a configuration is effectively the same as that described in Table 1. While this configuration would address peak power and misdirectionality issues, it would not address the problem of known dead nozzles, since only one of each redundant color channel would be able to be fired in a given line-time, thereby losing one of the major advantages of redundancy.

It would be desirable to provide a method of printing whereby fluctuations in a peak power requirement are minimized. It would be further desirable to provide a method of printing whereby the average power requirement of the printhead is substantially equal to the peak power requirement at any given time during printing. It would be further desirable to provide a method of printing, whereby, in addition minimizing fluctuating peak power requirements, the visual effects of dead or malfunctioning nozzles are reduced. It would be further desirable to provide a method of printing, whereby, in addition to minimizing fluctuating peak power requirements, the visual effects of misdirected ink droplets is reduced.

SUMMARY OF THE INVENTION

In a first aspect, there is provided a method of modulating a peak power requirement of an inkjet printhead, said printhead comprising a plurality of first nozzles and a plurality of second nozzles supplied with a same colored ink, said first nozzles and second nozzles being configured in a plurality of sets, wherein each set of nozzles comprises one first nozzle and one corresponding second nozzle, each nozzle in a set being configurable to print a dot of said ink onto a substantially same position on a print medium, said method comprising:

(a) selecting a firing nozzle from at least one set of nozzles, said selection being on the basis of modulating said peak power requirement; and (b) printing dots onto said print medium using said firing nozzle.

In a second aspect, there is provided a method of printing a line of dots from an inkjet printhead, said printhead comprising a plurality of first nozzles and a plurality of second nozzles supplied with a same colored ink, said first nozzles and second nozzles being configured in a plurality of sets, wherein each set of nozzles comprises one first nozzle and one corresponding second nozzle, each nozzle in a set being configurable to print a dot of said ink onto a substantially same position on a print medium, said method comprising printing a line of dots across said print medium such that said first nozzles and said second nozzles each contribute dots to said line.

In a third aspect, there is provided a method of modulating a peak power requirement of an inkjet printhead, said printhead comprising a plurality of transversely aligned color channels, each color channel comprising at least one nozzle row extending longitudinally along said printhead, each nozzle in a color channel ejecting the same colored ink, wherein said printhead is comprised of a plurality of printhead modules, each printhead module comprising a respective segment of each nozzle row, said method comprising each of said printhead modules firing a respective segment within a predetermined segment-time, wherein at least one of said fired segments is contained in a different color channel from at least one other of said fired segments.

In a fourth aspect, there is provided an inkjet printhead comprising a plurality of transversely aligned color channels, each color channel comprising at least one nozzle row extending longitudinally along said printhead, each nozzle in a row ejecting the same colored ink, wherein said printhead is comprised of a plurality of printhead modules, and the number of color channels is equal to the number of printhead modules.

In a fifth aspect, there is provided a printer controller for supplying dot data to an inkjet printhead, said printhead comprising a plurality of first nozzles and a plurality of second nozzles supplied with a same colored ink, said first nozzles and second nozzles being configured in a plurality of sets, wherein each set of nozzles comprises one first nozzle and one corresponding second nozzle, each nozzle in a set being configurable by said printer controller to print a dot of said ink onto a substantially same position on a print medium, said printer controller being programmed to supply dot data such that said first nozzles and said second nozzles each contribute dots to a line of printing.

In a sixth aspect, there is provided a printer controller for supplying dot data to a printhead, said printhead comprising a plurality of transversely aligned color channels, each color channel comprising at least one nozzle row extending longitudinally along said printhead, each nozzle in a color channel ejecting the same colored ink, wherein said printhead is comprised of a plurality of printhead modules, each printhead module comprising a respective segment of each nozzle row, said printer controller being programmed to supply dot data such that each of said printhead modules fires a respective segment within a predetermined segment-time, wherein at least one of said fired segments is contained in a different color channel from at least one other of said fired segments.

In a seventh aspect of the invention, there is provided a printhead system comprising an inkjet printhead and a printer controller for supplying dot data to said printhead, said printhead comprising a plurality of first nozzles and a plurality of second nozzles supplied with a same colored ink, said first nozzles and second nozzles being configured in a plurality of sets, wherein each set of nozzles comprises one first nozzle and one corresponding second nozzle, each nozzle in a set being configurable by said printer controller to print a dot of said ink onto a substantially same position on a print medium, said printer controller being programmed to supply dot data such that said first nozzles and said second nozzles each contribute dots to a line of printing.

In an eighth aspect of the invention, there is provided a printhead system comprising an inkjet printhead and a printer controller for supplying dot data to said printhead, said printhead comprising a plurality of transversely aligned color channels, each color channel comprising at least one nozzle row extending longitudinally along said printhead, each nozzle in a color channel ejecting the same colored ink, wherein said printhead is comprised of a plurality of printhead modules, each printhead module comprising a respective segment of each nozzle row, said printer controller being programmed to supply dot data such that each of said printhead modules fires a respective segment within a predetermined segment-time, wherein at least one of said fired segments is contained in a different color channel from at least one other of said fired segments.

All aspects of the invention provide the advantage of modulating a peak power requirement of the inkjet printhead. The corollary is that a power supply, which supplies power to the printhead, need not be specially adapted to supply severely fluctuating amounts of power throughout each print cycle. In the present invention, the degree of peak power fluctuations within each line-time are substantially reduced. Hence, the design and manufacture of the printhead power supply may be simplified and the power supply is made more robust by virtue of not having to deliver severely fluctuating amounts of power to the printhead.

In addition to modulating the peak power requirement of the printhead, the present invention allows print quality to be improved by using redundant nozzle rows, and without compromising the above-mentioned improvements in peak power requirement. Print quality may be improved by, for example, reducing the visual effects of unknown dead nozzles in the printhead, and reducing the visual effects of misdirected ink droplets.

As used herein, the terms "row", "rows of nozzles", "nozzle row" etc. may include nozzle rows comprising one or more displaced row portions.

As used herein, the term "ink" includes any type of ejectable fluid, including, for example, IR inks and fixatives, as well as standard CMYK inks. Likewise, references to "same colored ink" include inks of a same color or type e.g. same cyan ink, same IR ink or same fixative.

As used herein, the term "substantially the same position on a print medium" is used to mean that a droplet of ink has an intended trajectory to print at a same position on the print medium (as another droplet of ink). However, due to inherent error margins in firing droplets of ink, random misdirects or persistent misdirects, a droplet of ink may not be printed exactly on its intended position on the print medium. Hence, the term "substantially the same position on a print medium" includes misplaced droplets, which are intended to print at the same position, but may not necessarily print at that position.

In accordance with some forms of the invention, the first nozzles and second nozzles are configured in a plurality of sets, wherein each set of nozzles comprises one first nozzle and one corresponding second nozzle. Further, each nozzle in a set is configurable to print a dot of ink onto a substantially same position on a print medium, so that the nozzles can be used interchangeably.

Optionally, a set is a pair of nozzles consisting of one first nozzle and one second nozzle. However, a set may alternatively comprise further (e.g. third and fourth) nozzles, with each nozzle in the set being configurable to print a dot of ink onto a substantially same position on a print medium. In other words, the present invention is not limited to two rows of redundant nozzles and may include, for example, three or more rows of redundant nozzles.

Preferably, the printhead is a stationary pagewidth printhead and the print medium is fed transversely past the printhead. The present invention has been developed primarily for use with such pagewidth printheads.

Optionally, the printhead comprises a plurality of transversely aligned color channels, each color channel comprising at least one nozzle row extending longitudinally along the printhead, each nozzle in a color channel ejecting the same colored ink. As described in more detail below, each transversely aligned color channel is allotted a portion of a line-time for firing. In this way, dot-on-dot printing can be achieved, which is optimal for dithering.

Color channels in the printhead may eject the same or different colored inks. However, all nozzles in the same color channel are typically supplied with and eject the same colored ink. Color channels ejecting the same colored ink are sometimes termed 'redundant' color channels. Typically, the printhead comprises at least one redundant color channel so that at least one color channel ejects the same colored ink as at least one other color channel.

Each color channel may comprise a plurality of nozzle rows. Optionally, each color channel comprises a pair of nozzle rows. Typically, nozzle rows in the same color channel are transversely offset from each other. For example, one nozzle row in a pair may be configured to print even dots on a line, while the other nozzle row in the pair may be configured to print odd dots on the same line. The nozzle rows in a pair are usually spaced apart in a transverse direction to allow convenient timing of nozzle firings. For example, the even and odd nozzle rows in one color channel may be spaced apart by two lines of printing.

Optionally, each set of nozzles comprises one first nozzle from a first color channel and one second nozzle from a second color channel. The first and second nozzles in the set are aligned transversely so that each can print onto the substantially same position on a print medium.

Optionally, one set of nozzles prints a column of same-colored dots down a print medium, with each nozzle in the set contributing dots to the column. As used herein, a "column" refers to a line of dots printed substantially perpendicular to the printhead and substantially parallel with a feed direction of the print medium. Optionally, one first nozzle in the set prints about half of the column and one second nozzle in the set prints about half of the column, so that the first and second nozzles in the set share printing of the column equally between them.

Optionally, a visual effect of misdirected ink droplets is reduced. An advantage of using a plurality (e.g. two) nozzles for printing the same column is that misdirected ink droplets may be averaged out between those nozzles.

Optionally, when printing a line of same-colored dots across the print medium, the first nozzles and second nozzles contribute dots to the line. As used herein, a "line" refers to a line of dots printed substantially parallel with the printhead and substantially perpendicular to a feed direction of the print medium. Optionally, the first nozzles print about half of the line and the second nozzles print about half of the line, so that the first and second nozzles share printing of the line equally between them. Accordingly, the peak power requirement for printing the line is reduced by about 50%, as compared to printing the line using only first nozzles or only second nozzles. Optionally, alternate first nozzles in a first nozzle row are used to print about half of the line and alternate second nozzles in a second nozzle row are used to print about half of the line. However, other patterns for sharing printing between the first and second nozzles may also be used.

Optionally, a visual effect of malfunctioning or dead nozzles is reduced. The nozzles may be known dead nozzles or unknown dead nozzles. The visual effect of an unknown dead nozzle is reduced by virtue of the fact that the nozzle is only required to print about half of the time. For example, with an unknown dead magenta nozzle, a column of magenta dots would be missing completely with no redundancy, whereas half of the column is still printed using redundancy. The latter is, of course, far more visually acceptable than the former.

Optionally, the color (which is the same color printed by the first and second nozzles) is magenta, cyan or black. The human eye is most sensitive to magenta, cyan and black, and these colors are consequently the preferred candidates for redundancy. A printhead may contain more than one redundant color channels. For example, the printhead may comprise first and second magenta nozzles, and first and second cyan nozzles.

In accordance with some forms of the invention, there is provided a method of out-of-phase printing so as to modulate a peak power requirement of the printhead. Typically, the printhead comprises a plurality of transversely aligned color channels with each color channel comprising at least one nozzle row extending longitiudinally along the printhead. Each nozzle in a color channel is supplied with and ejects the same colored ink. Typically, the printhead is comprised of a plurality of printhead modules, with each module comprising a respect segment of each nozzle row. Out-of-phase printing is provided by a method in which each of the printhead modules fires a respective segment within a predetermined segment-time, wherein at least one of the fired segments is contained in a different color channel from at least one other of the fired segments.

A segment-time may be defined as a predetermined fraction of one line-time. A line-time is defined as the time taken for the print medium to advance past the printhead by one line. Typically, all segments in a nozzle row are fired within one line-time. Optionally, a segment-time is equal to one line-time divided by the number of nozzle rows. However, a period of each line-time may be dedicated to a line-based overhead, in which case the segment-time will be less than one line-time divided by the number of nozzle rows. Generally, all segment-times are equal.

Optionally, at least one nozzle row has a different peak power requirement from other nozzle rows. For example, a redundant nozzle row would normally have half the peak power requirement of a non-redundant nozzle row. Optionally, a predetermined firing sequence modulates the peak power requirement during each segment-time so that the peak power requirement is within about 10%, optionally within 5%, of the average power requirement of the printhead. In some embodiments of the invention, the peak power requirement of the printhead is equal to the average power requirement of the printhead.

Typically, all segments on the printhead are fired within one-line time.

In some forms of the invention, the number of color channels is equal to the number of printhead modules. This is the optimum number of color channels and modules to achieve perfect out-of-phase firing. However, as will be explained in more detail below, the advantages of out-of-phase firing may still be achieved using any number of printhead modules and color channels.

Optionally, with equal numbers of modules and color channels, each of the printhead modules fires a segment from a different color channel within the predetermined segment-time. Further, each segment in a nozzle row may be fired sequentially. However, as will be explained in more detail below, each segment in a nozzle row need not be fired sequentially, whilst still enjoying the advantages of out-of-phase firing.

BRIEF DESCRIPTION OF THE DRAWINGS

Specific forms of the present invention will be now be described in detail, with reference to the following drawings, in which.

DETAILED DESCRIPTION OF THE INVENTION

Figure 1:
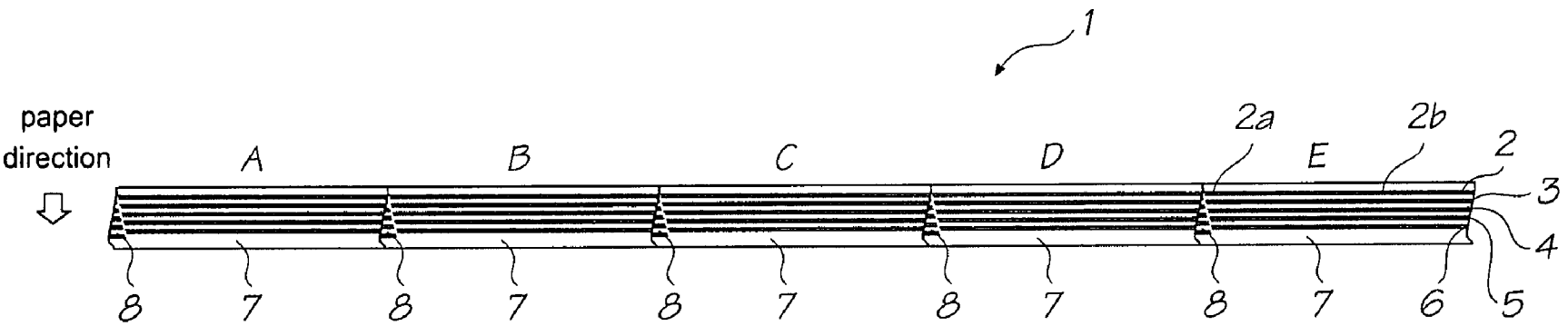
FIG. 1 is a plan view of a pagewidth printhead according to the invention.

The invention will be described with reference to a CMY pagewidth inkjet printhead 1, as shown in FIG. 1. The printhead 1 has five color channels 2, 3, 4, 5 and 6, which are C1, C2, M1, M2 and Y respectively. In other words cyan and magenta have 'redundant' color channels. The reason for making C and M redundant is that Y only contributes 11% of luminance, while C contributes 30% and M contributes 59%. Since the human eye is least sensitive to yellow, it is more visually acceptable to have missing yellow dots than missing cyan or magenta dots. In this printhead, black (K) printing is achieved via process-black (CMY).

The printhead 1 is comprised of five abutting printhead modules 7, which are referred to from left to right as A, B, C, D and E. The five modules 7 cooperate to form the printhead 1, which extends across the width of a page (not shown) to be printed. In this example, each module 7 has a length of about 20 mm so that the five abutting modules form a 4" printhead, suitable for pagewidth 4"×6" color photo printing. During printing, paper is fed transversely past the printhead 1 and FIG. 1 shows this paper direction.

Each of the five color channels on the printhead 1 comprises a pair of nozzle rows. For example, the C1 color channel 2 comprises nozzle rows 2*a* and 2*b*. These nozzle rows 2*a* and 2*b* extend longitudinally along the whole length of the printhead 1. Where abutting printhead modules 7 are joined, there is a displaced (or dropped) triangle 8 of nozzle rows. These dropped triangles 8 allow printhead modules 7 to be joined, whilst effectively maintaining a constant nozzle pitch along each row. A timing device (not shown) is used to delay firing nozzles in the dropped triangles 8, as appropriate. A more detailed explanation of the operation of the dropped triangle 8 is provided in the Applicant's patent applications U.S. Ser. No. 10/854,512, filed May 27, 2004 and U.S. Ser. No. 10/854,491, filed May 27, 2004.

Figure 2:
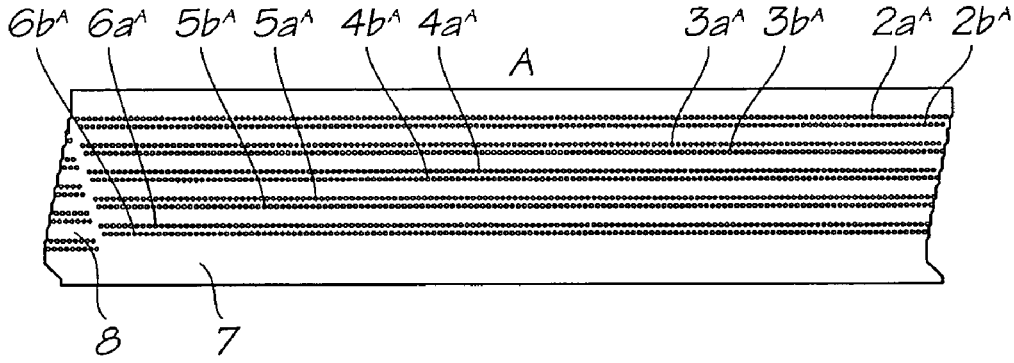
FIG. 2 is a plan view of a printhead module, which is a part of the printhead shown in FIG. 1.

Each of the printhead modules 7 contains a segment from each of the nozzle rows. For example, printhead module A contains segments $\mathbf{2}a^A$, $\mathbf{2}b^A$, $\mathbf{3}a^A$, $\mathbf{3}b^A$, $\mathbf{4}a^A$ etc. Segments from the same nozzle row cooperate to form a complete nozzle row. For example, segments $\mathbf{2}a^A$, $\mathbf{2}a^B$, $\mathbf{2}a^C$, $\mathbf{2}a^D$ and $\mathbf{2}a^E$ cooperate to form nozzle row 2*a*. FIG. 2 shows the printhead module A with its respect segments from each nozzle row.

Figure 3:
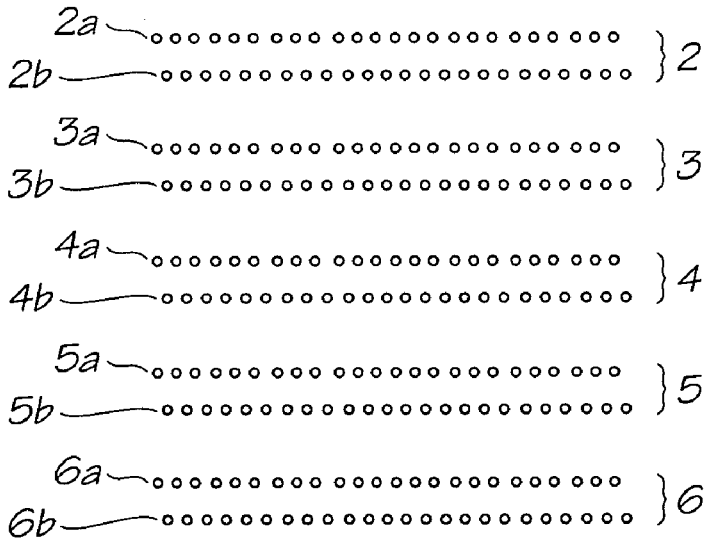
FIG. 3 is a schematic representation of a portion of each color channel of the printhead shown in FIG. 1.

Referring to FIG. 3, there is shown a detailed schematic view of a portion of the five color channels 2, 3, 4, 5 and 6. From FIG. 3, it can be seen that the pair of nozzle rows (e.g. 2*a* and 2*b*) in each color channel (e.g. 2) are transversely offset from each other. In color channel 2, for example, nozzle row 2*a* prints even dots in a line, while nozzle row 2*b* prints interstitial odd dots in a line.

Furthermore, the even rows of nozzles 2*a*, 3*a*, 4*a*, 5*a* and 6*a* are transversely aligned, as are the odd rows of nozzles 2*b*, 3*b*, 4*b*, 5*b* and 6*b*. This transverse alignment of the five color channels allows dot-on-dot printing, which is optimal in terms of dithering. Within a period of one line-time, all even nozzles and all odd nozzles must be fired so that dot-on-dot printing is achieved. The even and odd nozzles (e.g. 2*a* and 2*b*) in the same color channel (e.g. 2) may be separated by, for example, two lines. Adjacent color channels (e.g. 2 and 3) may be separated by, for example, ten lines. However, it will be appreciated that the exact spacing between even/odd nozzle rows and adjacent color channels may be varied, whilst still achieving dot-on-dot printing.

Dot-at-a-Time Redundancy

In the printhead 1 described above, there are two cyan (C1, C2) and two magenta (M1, M2) color channels. In the Applicant's terminology, the C1/C2 and M1/M2 color channels are described as 'redundant' color channels.

As explained above, with five color channels and a pair of nozzle rows in each color channel, each nozzle row must print in one-tenth of the line-time in order to achieve all the advantages of redundancy and compensate for any known dead nozzles using a redundant color channel. The inherent power supply problems in relation to the redundancy scheme described in U.S. Ser. No. 10/854,507, filed May 27, 2004 and U.S. Ser. No. 10/854,523, filed May 27, 2004 have also been described above.

Dot-at-a-time redundancy is where redundant rows of nozzles are used such that there is never more than one out of every two adjacent nozzles firing within a single nozzle row. In other words, the even dots for a color are produced by two nozzle rows (each printing half of the even dots), and the odd dots for a color are produced by two nozzle rows (each printing half of the dots). For example, nozzle rows 2*a* and 3*a* may both contribute even dots to a line of printing, and nozzle rows 2*b* and 3*b* may both contribute odd dots to a line of printing.

Figure 4A:
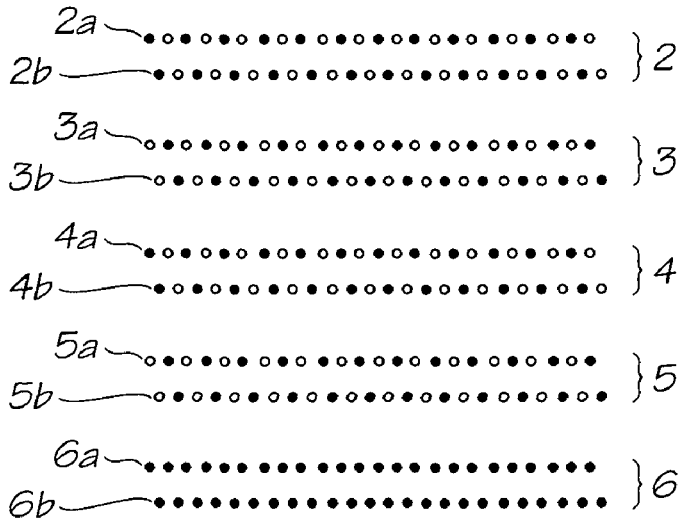
FIG. 4A shows which even nozzles fire in one line-time using dot-at-a-time redundancy according to the invention.
Figure 4B:
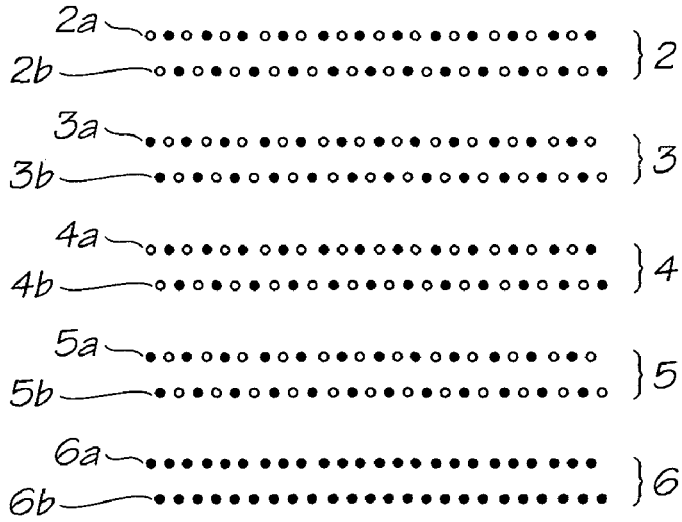
FIG. 4B shows which odd nozzles fire in the next line-time from FIG. 4A.

FIGS. 4A and 4B show a firing sequence for two lines of printing using dot-at-a-time redundancy. The nozzles indicated in FIGS. 4A and 4B are not fired simultaneously; each nozzle row is allotted one-tenth of the line-time in which to fire its nozzles, with even nozzles rows firing sequentially followed by odd nozzle rows firing sequentially.

Referring to FIG. 4A, in the first line-time alternate nozzles are fired in each nozzle row from the C1, C2, M1 and M2 color channels. Nozzles fired from C2 and M2 complement those fired from C1 and M1. For example, alternate even nozzles are fired from nozzle row 2*a* and complementary alternate even nozzles are fired from nozzle row 3*a*. Nozzle rows 6*a* and 6*b* in the Y channel have no redundancy and each of these nozzle rows must therefore fire all its nozzles in one-tenth of the line-time.

Referring to FIG. 4B, in the second line-time the alternate nozzles fired in the first line-time are inversed.

By using this dot-at-a-time redundancy scheme, print quality is improved by reducing misdirection artifacts (thereby maximizing dot-on-dot placement) and reducing the visual effect of unknown dead nozzles. For example, if half of the dots in a column are from an operational nozzle and half are from a dead nozzle, the visual effect of the dead nozzle will be reduced and the effective print quality is greater than if the entire column came from the dead nozzle. In other words, the present invention achieves at least as good print quality as the line-at-a-time redundancy described in U.S. Ser. No. 10/854,507, filed May 27, 2004 and U.S. Ser. No. 10/854,523, filed May 27, 2004.

Moreover, the peak power requirements of the printhead are modulated during printing of each line, so that the peak power requirements do not fluctuate as severely as in Table 2. Table 3 shows how the peak power requirement of the printhead (having an average power requirement of x) varies over two lines of printing using dot-at-a-time redundancy according to the present invention:

TABLE 3

| Line-time | Color Channel | Nozzle Row | Peak Power Requirement |
|---|---|---|---|
| 0 | 2 (C1) | 2a (even) | 0.83x |
| 0.1 | 3 (C2) | 3a (even) | 0.83x |
| 0.2 | 4 (M1) | 4a (even) | 0.83x |
| 0.3 | 5 (M2) | 5a (even) | 0.83x |
| 0.4 | 6 (Y) | 6a (even) | 1.67x |
| 0.5 | 2 (C1) | 2b (odd) | 0.83x |
| 0.6 | 3 (C2) | 3b (odd) | 0.83x |
| 0.7 | 4 (M1) | 4b (odd) | 0.83x |
| 0.8 | 5 (M2) | 5b (odd) | 0.83x |
| 0.9 | 6 (Y) | 6b (odd) | 1.67x |
| 0 (new line) | 2 (C1) | 2a (even) | 0.83x |
| 0.1 | 3 (C2) | 3a (even) | 0.83x |
| 0.2 | 4 (M1) | 4a (even) | 0.83x |
| 0.3 | 5 (M2) | 5a (even) | 0.83x |
| 0.4 | 6 (Y) | 6a (even) | 1.67x |
| 0.5 | 2 (C1) | 2b (odd) | 0.83x |
| 0.6 | 3 (C2) | 3b (odd) | 0.83x |
| 0.7 | 4 (M1) | 4b (odd) | 0.83x |
| 0.8 | 5 (M2) | 5b (odd) | 0.83x |
| 0.9 | 6 (Y) | 6b (odd) | 1.67x |
| 0 (new line) | 2 (C1) | 2a (even) | 0.83x . . . etc |

It is evident from Table 3 that the fluctuations in peak power requirement are fewer and less severe compared to line-at-a-time redundancy, described in Table 2. In terms of the design of the printhead power supply, dot-at-a-time redundancy according to the present invention offers significant advantages over line-at-a-time redundancy, whilst maintaining the same improvements in print quality.

Out-of-Phase Firing

In all the firing sequences described so far, each color channel is fired in-phase—that is, a whole row of, say, even nozzles from one color channel is fired within its allotted portion of the line-time. In-phase firing provides simpler programming of the printer controller, which controls the firing sequence via dot data sent to the printhead 1.

However, according to another form of the present invention, the firing may be out-of-phase—that is, within the same allotted portion of the line-time (termed the 'segment-time'), at least one segment of nozzles is fired from a color channel that is different from at least one other segment of nozzles. With appropriate sequencing of segment firings, a whole nozzle row can be fired within one line-time, such that the net result is effectively the same as in-phase firing.

In the case of the printhead 1, having five color channels and five segments in each nozzle row, it possible to fire segments from all different color channels within one segment time (i.e. one-tenth of a line-time). Segments contained in the same nozzle row are, therefore, fired sequentially during one line-time.

A major advantage of out-of-phase firing is that if one or more color channels (e.g. Y) has a different peak power requirement to the other color channels, this difference is averaged into the power requirements of the other color channels within each segment-time. Hence, the spike in power (corresponding to the Y channel) in Table 3 is effectively merged into rest of the line-time. The result is that the peak power requirement during each segment-time is always equal to the average power requirement for the printhead. This situation is optimal for supplying power to the printhead.

Table 4 illustrates a sequence of out-of-phase firing for one line of printing from the printhead 1, using dot-at-a-time redundancy.

TABLE 4

| Line-time | Module A (CC, S, P) | Module B (CC, S, P) | Module C (CC, S, P) | Module D (CC, S, P) | Module E (CC, S, P) | Peak Power Requirement |
|---|---|---|---|---|---|---|
| 0 | C1, $2a^A$, 0.83x | C2, $3a^B$, 0.83x | M1, $4a^C$, 0.83x | M2, $5a^D$, 0.83x | Y, $6a^E$, 1.67x | x |
| 0.1 | C2, $3a^A$, 0.83x | M1, $4a^B$, 0.83x | M2, $5a^C$, 0.83x | Y, $6a^D$, 1.67x | C1, $2a^E$, 0.83x | x |
| 0.2 | M1, $4a^A$, 0.83x | M2, $5a^B$, 0.83x | Y, $6a^C$, 1.67x | C1, $2a^D$, 0.83x | C2, $3a^E$, 0.83x | x |
| 0.3 | M2, $5a^A$, 0.83x | Y, $6a^B$, 1.67x | C1, $2a^C$, 0.83x | C2, $3a^D$, 0.83x | M1, $4a^E$, 0.83x | x |
| 0.4 | Y, $6a^A$, 1.67x | C1, $2a^B$, 0.83x | C2, $3a^C$, 0.83x | M1, $4a^D$, 0.83x | M2, $5a^E$, 0.83x | x |
| 0.5 | C1, $2b^A$, 0.83x | C2, $3b^B$, 0.83x | M1, $4b^C$, 0.83x | M2, $5b^D$, 0.83x | Y, $6b^E$, 1.67x | x |
| 0.6 | C2, $3b^A$, 0.83x | M1, $4b^B$, 0.83x | M2, $5b^C$, 0.83x | Y, $6b^D$, 1.67x | C1, $2b^E$, 0.83x | x |
| 0.7 | M1, $4b^A$, 0.83x | M2, $5b^B$, 0.83x | Y, $6b^C$, 1.67x | C1, $2b^D$, 0.83x | C2, $3b^E$, 0.83x | x |
| 0.8 | M2, $5b^A$, 0.83x | Y, $6b^B$, 1.67x | C1, $2b^C$, 0.83x | C2, $3b^D$, 0.83x | M1, $4b^E$, 0.83x | x |
| 0.9 | Y, $6b^A$, 1.67x | C1, $2b^B$, 0.83x | C2, $3b^C$, 0.83x | M1, $4b^D$, 0.83x | M2, $5b^E$, 0.83x | x |
| 0 (new line) | C1, $2a^A$, 0.83x | C2, $3a^B$, 0.83x | M1, $4a^C$, 0.83x | M2, $5a^D$, 0.83x | Y, $6a^E$, 1.67x | x ... etc |

CC = Color Channel;
S = Segment;
P = Peak Power Requirement

It should be remembered that, even within one segment, not all nozzles fire simultaneously. The nozzles in one segment are arranged in firing groups, which fire sequentially over the course of their allotted segment-time. However, the important point is that at any given instant, some C1, C2, M1, M2 and Y nozzles will fire simultaneously, thereby averaging out the higher peak power requirement of the yellow nozzle row.

In the case of five printhead modules and five color channels, it can be seen that out-of-phase firing works out well. Segments from each color channel can be rotated so that all different segments are fired in one segment-time.

However, it will be appreciated that out-of-phase firing also works well with any number of printhead modules or color channels. For example, using 20 mm printhead modules 7, an A4 pagewidth printhead is comprised of eleven abutting modules [(i) to (xi)]. With five color channels and eleven printhead modules, it is impossible to ensure that each printhead module fires a different color channel within a segment-time (i.e. one-tenth of a line-time). Regardless, out-of-phase firing can still be used to optimize the peak power requirement of the printhead.

For example, the A4 pagewidth printhead may have C, M, Y, K1 and K2 color channels. Since there are redundant K channels, these nozzle rows will have a lower peak power requirement than the C, M and Y channels using dot-at-a-time redundancy. Using in-phase firing, there would be appreciable peak power fluctuations during each line-time (C=1.25x, M=1.25x, Y=1.25x, K1=0.625x, K2=0.625x).

However, it can be seen from Table 5 that out-of-phase firing accommodates the eleven printhead modules and provides a peak power requirement that is always within 10% of the average power requirement x of the printhead. Indeed, the peak power requirement is always within 5% of the average power requirement x in this example. For the purposes of providing a power supply for the printhead, such small variations in peak power requirement during each line-time are not significant and would not affect the design of the power supply.

TABLE 5

| t | (i) | (ii) | (iii) | (iv) | (v) | (vi) | (vii) | (viii) | (ix) | (x) | (xi) | P |
|---|---|---|---|---|---|---|---|---|---|---|---|---|
| 0 | C(e) | M(e) | Y(e) | K1(e) | K2(e) | C(e) | M(e) | Y(e) | K1(e) | K2(e) | C(e) | 1.023x |
| 0.1 | M(e) | Y(e) | K1(e) | K2(e) | C(e) | M(e) | Y(e) | K1(e) | K2(e) | C(e) | M(e) | 1.023x |
| 0.2 | Y(e) | K1(e) | K2(e) | C(e) | M(e) | Y(e) | K1(e) | K2(e) | C(e) | M(e) | Y(e) | 1.023x |
| 0.3 | K1(e) | K2(e) | C(e) | M(e) | Y(e) | K1(e) | K2(e) | C(e) | M(e) | Y(e) | K1(e) | 0.966x |
| 0.4 | K2(e) | C(e) | M(e) | Y(e) | K1(e) | K2(e) | C(e) | M(e) | Y(e) | K1(e) | K2(e) | 0.966x |
| 0.5 | C(o) | M(o) | Y(o) | K1(o) | K2(o) | C(o) | M(o) | Y(o) | K1(o) | K2(o) | C(o) | 1.023x |
| 0.6 | M(o) | Y(o) | K1(o) | K2(o) | C(o) | M(o) | Y(o) | K1(o) | K2(o) | C(o) | M(o) | 1.023x |
| 0.7 | Y(o) | K1(o) | K2(o) | C(o) | M(o) | Y(o) | K1(o) | K2(o) | C(o) | M(o) | Y(o) | 1.023x |
| 0.8 | K1(o) | K2(o) | C(o) | M(o) | Y(o) | K1(o) | K2(o) | C(o) | M(o) | Y(o) | K1(o) | 0.966x |
| 0.9 | K2(o) | C(o) | M(o) | Y(o) | K1(o) | K2(o) | C(o) | M(o) | Y(o) | K1(o) | K2(o) | 0.966x |
| 0 | C(o) | M(o) | Y(o) | K1(o) | K2(o) | C(o) | M(o) | Y(o) | K1(o) | K2(o) | C(o) | 1.023x |

t = line-time;
P = Peak Power Requirement
(e) = even rows of nozzles;
(o) = odd rows of nozzles From the foregoing it will be appreciated that the combination of out-of-phase firing together with dot-at-a-time redundancy is optimal for achieving excellent print quality and an acceptable power requirement for the printhead during printing.

However, these methods of printing may equally be used individually, providing their inherent advantages, or in combination with other methods of printing. For example, out-of-phase firing or dot-at-a-time redundancy may be used in combination with printhead module misplacement correction and/or dead nozzle compensation, as described in our earlier patent applications U.S. Ser. No. 10/854,521 filed May 27, 2004 and U.S. Ser. No. 10/854,515, filed May 27, 2004.

Printer Controller

Figure 5:
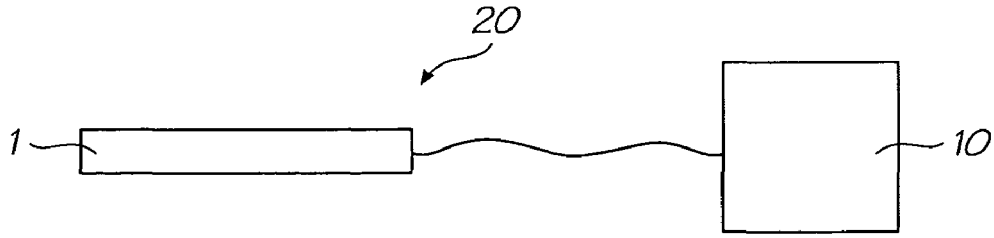
FIG. 5 shows a printhead system according to the invention.

It will also be appreciated by the skilled person that a printer controller 10, shown schematically in FIG. 5, may be suitably programmed to provide dot data to the printhead 1, so as to print in accordance with the methods described above. A printhead system 20 comprises the printer controller 10 and the printhead 1, which is controlled by the controller. The printer controller 10 communicates dot data to the printhead 1 for printing.

A suitable type of printer controller, which may be programmed accordingly, was described in our earlier patent application U.S. Ser. No. 10/854,521 filed May 27, 2004.

It will, of course, be appreciated that the present invention has been described purely by way of example and that modifications of detail may be made within the scope of the invention, which is defined by the accompanying claims.

The invention claimed is:

1. An inkjet printhead that comprises a number of printhead modules arranged end-to-end to span a width of a page, the printhead modules defining color channels in form of C1, C2, M1, M2 and Y color channels, C1 and C2 being two respective cyan channels, M1 and M2 being two respective magenta channels and Y being a yellow channel, also to span the width of the page;

a plurality of inkjet nozzles arranged on the modules such that rows of the nozzles span the width of the page, with at least one row of nozzles in fluid communication with respective channels, the nozzles capable of being fired to eject ink from their associated channels, the nozzles of each row on an associated module defining a segment of nozzles; and a printer controller for controlling a firing sequence of the nozzles, the printer controller being configured so that nozzles from segments associated with different color channels are fired sequentially during a predetermined time allocated for firing a row of nozzles, and nozzles in each segment are arranged in firing groups that fire sequentially over an allocated segment time, wherein each of said ink color channels associates with two rows of nozzles, the controller being configured to fire redundant said two rows of nozzles such that never more than one out of every two adjacent nozzles fire within a single nozzle row to modulate peak power requirements of the printhead, and wherein the controller being configured so that all different segments associated with said color channels are fired in a firing time allocated to one segment that is a fraction of time allocated for firing a row of nozzles.

2. An inkjet printhead as claimed in claim 1, in which the printhead modules are arranged to abut each other.

3. An inkjet printhead as claimed in claim 1, in which the nozzle rows in each color channel are transversely offset with respect to each other.

4. An inkjet printhead as claimed in claim 3, in which even and odd nozzles in each color channel are transversely aligned with respective even and odd nozzles in other color channels.

* * * * *